United States Patent [19]

Witte

[11] 4,286,544

[45] Sep. 1, 1981

[54] CROSS-MIXING SYSTEM

[75] Inventor: John C. Witte, Penfield, N.Y.

[73] Assignee: Xerox Corporation, Stamford, Conn.

[21] Appl. No.: 136,625

[22] Filed: Apr. 2, 1980

[51] Int. Cl.[3] ..... G03G 15/09
[52] U.S. Cl. ..... 118/657; 427/47
[58] Field of Search ..... 118/657; 427/47

[56] References Cited

U.S. PATENT DOCUMENTS 3,037,478 6/1962 Lace ..... 118/657

*Primary Examiner*—Bernard D. Pianalto
*Attorney, Agent, or Firm*—H. M. Brownrout; C. A. Green; H. Fleischer

[57] ABSTRACT

An apparatus in which developer material is transported to a latent image so as to be deposited thereon to form a powder image thereof. The apparatus includes a mixer disposed interiorly of the transport, for mixing the developer material.

22 Claims, 3 Drawing Figures

CROSS-MIXING SYSTEM

This invention relates generally to an apparatus for mixing developer material. An apparatus of this type is frequently employed in the development system of an electrophotographic printing machine.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive member corresponding to the informational areas contained within the original document. After the electrostatic latent image is recorded on the photoconductive member, the latent image is developed by bringing the developer material into contact therewith. This forms a powder image on the photoconductive member which is subsequently transferred to a copy sheet. Finally, the powder image is heated to permanently affix it to the copy sheet in image configuration.

Generally, developer material comprises carrier granules having toner particles adherring triboelectrically thereto. During development, the toner particles are attracted from the carrier granules to the latent image. Thus, toner particles are depleted from the developer material during usage. It therefore becomes necessary to furnish additional toner particles to the system in order to maintain the concentration thereof substantially constant. As the toner particles are depleted from the developer material, new toner particles are added thereto. Hcwever, frequently the new toner particles remain segregated from the carrier granules. It is, therefore, necessary to mix the toner particles with the carrier granules in order to maintain the desired triboelectric characteristics and to insure that the concentration of the toner particles throughout the developer material is substantially uniform. Various techniques have been devised for intermingling the toner particles with the carrier granules. This includes both passive and active approaches. In a passive approach, different types of baffles are employed for controlling the direction of flow of the toner particles and carrier granules so as to optimize mixing therebetween. In an active system, the mixing device moves so as to mix the carrier granules and toner particles with one another. Various types of active systems have been developed which achieve mixing of the toner particles and carrier granules. The following disclosures appear to be relevant:

U.S. Pat. No. 3,233,586 Patentee: Cranskins et al. Issued: Feb. 8, 1966

U.S. Pat. No. 3,437,074 Patentee: Hagopian et al. Issued: Apr. 8, 1969

U.S. Pat. No. 3,641,980 Patentee: Bickmore Issued: Feb. 15, 1972

U.S. Pat. No. 3,754,526 Patentee: Caudill Issued: Aug. 28, 1973

U.S. Pat. No. 3,881,446 Patentee: Kurita et al. Issued: May 6, 1975

U.S. Pat. No. 3,906,121 Patentee: Fraser et al. Issued: Sept. 16, 1975

Co-pending U.S. Patent Appln. Ser. No. 80,650 Applicant: Stange Filed: Oct. 1, 1979

The pertinent portions of the foregoing disclosures may be briefly summarized as follows:

Cranskins et al. describes a helical stripper which removes developer powder from a roller surface and provides mixing thereof.

Hagopian et al. discloses a paddle wheel which continually mixes the carrier granules and toner particles.

Bickmore describes a pair of augers which maintain the developer material in a loose consistency and provide thorough mixing thereof.

Caudill discloses a pair of counter-rotating augers that stirs the freshly added toner with the developer material to insure complete mixing as well as enhancing the triboelectric charging of the developer material.

Kurita et al. discloses a vaned cylinder for mixing the developer material.

Fraser et al. describes a rotating vaned mixing member for maintaining uniformity of the developer material in the developer reservoir.

Stange discloses a developer roller comprising a plurality of spaced magnetic strips which enable the developer material to pass to the interior thereof.

In accordance with the features of the present invention, there is provided an apparatus for developing a latent image with developer material. The apparatus includes means for transporting the developer material to the latent image so as to deposit developer material thereon. Means, mounted interiorly of the transporting means, mix the developer material.

Other aspects of the present invention will become apparent as the following description proceeds and upon reference to the drawings in which:

While the present invention will hereinafter be described in conjunction with a preferred embodiment thereof, it will be understood that it is not intended to limit the invention to this embodiment. On the contrary, it is intended to cover all alternatives, modifications and equivalents as may be included within the spirit and scope of the invention as defined by the appended claims.

Figure 1:
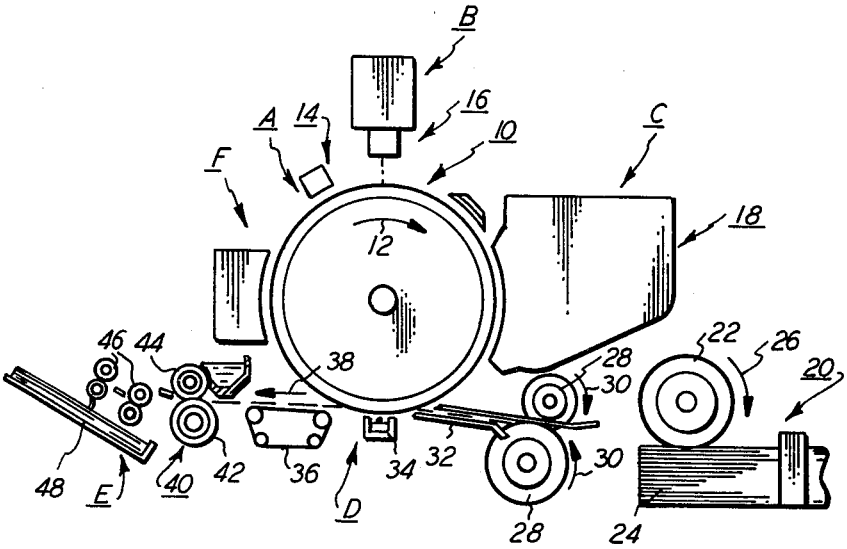
FIG. 1 is a schematic elevational view depicting an electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the development system of the present invention therein. It will become evident from the following discussion that the development system described hereinafter is equally well suited for use in a wide variety of electrostatographic printing machines and is not necessarily limited in its application to the particular embodiment shown herein.

Inasmuch as the art of electrophotographic printing is well known, the various processing stations employed in the FIG. 1 printing machine will be shown hereinafter schematically and the operation thereof described briefly with reference thereto.

As shown in FIG. 1, the electrophotographic printing machine utilizes a drum, indicated generally by the reference numeral 10. Preferably, drum 10 includes a conductive substrate, such as aluminum, having a photoconductive material, e.g. a selenium alloy, deposited thereon. Drum 10 rotates in the direction of arrow 12 to pass through the various processing stations disposed thereabout.

Initially, drum 10 moves a portion of the photoconductive surface through charging station A. At charging station A, a corona generating device, indicated generally by the reference numeral 14, charges the photoconductive surface of drum 10 to a relatively high, substantially uniform potential.

Thereafter, the charged portion of the photoconductive surface of drum 10 is advanced through exposure station B. At exposure station B, an original document is positioned face-down upon a transparent platen. The exposure system, indicated generally by the reference numeral 16, includes a lamp which moves across the original document illuminating incremental widths thereof. The light rays reflected from the original document are transmitted through a moving lens system to form incremental width light images. These light images are focused onto the charged portion of the photoconductive surface. In this manner, the charged conductive surface of drum 10 is discharged selectively by the light image of the original document. This records an electrostatic latent image on the photoconductive surface which corresponds to the informational areas contained within the original document. It has been found that illuminating the charged portion of the photoconductive surface fails to totally discharge the photoconductive surface. Thus, the photoconductive surface retains background charge areas which are of some residual voltage level. For example, the background areas may have a nominal potential of about 50 volts while the electrostatic latent image or image areas may have a nominal potential of about 350 volts.

Next, drum 10 advances the electrostatic latent image recorded on the photoconductive surface to development station C. At development station C, a magnetic brush development system, indicated generally by the reference numeral 18, transports the developer material to the photoconductive surface of drum 10. The developer material comprises carrier granules and toner particles. Preferably, the carrier granules are made from ferromagnetic material with the toner particles being made from a thermoplastic material. The toner particles adhere triboelectrically to the carrier granules. During development, the toner particles are attracted to the electrostatic latent image to form a toner powder image on the photoconductive surface. The toner particles may be charged either positively or negatively with the potential applied to the photoconductive surface being of a polarity opposite thereto. During development, toner particles are depleted from the developer material. This requires the addition of new toner particles to the developer material so as to maintain the concentration thereof substantially constant. If the concentration of toner particles within the developer material is reduced beyond a predetermined amount, copy quality is severely degradated. In order to insure that the toner particles are uniformly dispersed throughout the developer material with the proper triboelectric characteristics, the toner particles and developer material must be mixed. This is achieved by a mixing device disposed interiorly of the magnetic brush developer roller. The detailed structure of development system 18 will be described hereinafter with reference to FIGS. 2 and 3.

Continuing now with the various processing stations disposed in the electrophotographic printing machine, after the powder image is deposited on the photoconductive surface, drum 10 advances the powder image to transfer station D.

At transfer station D, a sheet of support material is positioned in contact with the powder image formed on the photoconductive surface of drum 10. The sheet of support material is advanced to the transfer station by a sheet feeding apparatus, indicated generally by the reference numeral 20. Preferably, sheet feeding apparatus 20 includes a feed roll 22 contacting the uppermost sheet of the stack 24 of sheets of support material. Feed roll 22 rotates in the direction of arrow 26 so as to advance the uppermost sheet from stack 24. Registration rollers 28, rotating in the direction of arrow 30, align and forward the advancing sheet of support material into chute 32. Chute 32 directs the advancing sheet of support material into contact with the photoconductive surface of drum 10 in a timed sequence. This insures that the powder image contacts the advancing sheet of support material at transfer station D.

Transfer station D includes a corona generating device 34, which applies a spray of ions to the backside of the sheet. This attracts the powder image from the photoconductive surface of drum 10 to the sheet. After transfer, the sheet continues to move with drum 10. A detack corona generating device (not shown) neutralizes the charge causing the sheet to adhere to drum 10 permitting separation of the sheet therefrom. Conveyor 36 advances the sheet, in the direction of arrow 38, from transfer station D to fusing station E.

Fusing station E, indicated generally by the reference numeral 40, includes a back-up roller 42 and a heated fuser roller 44. The sheet of support material with the powder image thereon, passes between back-up roller 42 and fuser roller 44. The powder image contacts fuser roller 44 and the heat and pressure applied thereto permanently affixes it to the sheet of support material. After fusing, forwarding rollers 46 advance the finished copy sheet to catch tray 48. Once the copy sheet is positioned in catch tray 48, it may be removed therefrom by the machine operator.

Invariably, after the sheet of support material is separated from the photoconductive surface of drum 10, some residual particles remain adhering thereto. These residual particles are cleaned from drum 10 at cleaning station F. Preferably, cleaning station F includes a cleaning mechanism 50 which comprises a pre-clean corona generating device and a rotatably mounted fiberous brush in contact with the photoconductive surface of drum 10. The pre-clean corona generating device neutralizes the charge attracting the particles to the photoconductive surface. The particles are then cleaned from the photoconductive surface by the rotation of the brush in contact therewith. Subsequent to cleaning a discharge lamp floods the photoconductive surface with light to dissipate any residual electrostatic charge remaining thereon prior to the charging thereof for the next successive imaging cycle.

It is believed that the foregoing description is sufficient for purposes of the present invention to illustrate the general operation of an electrophotographic printing machine incorporating the features of the present invention therein.

Figure 2:
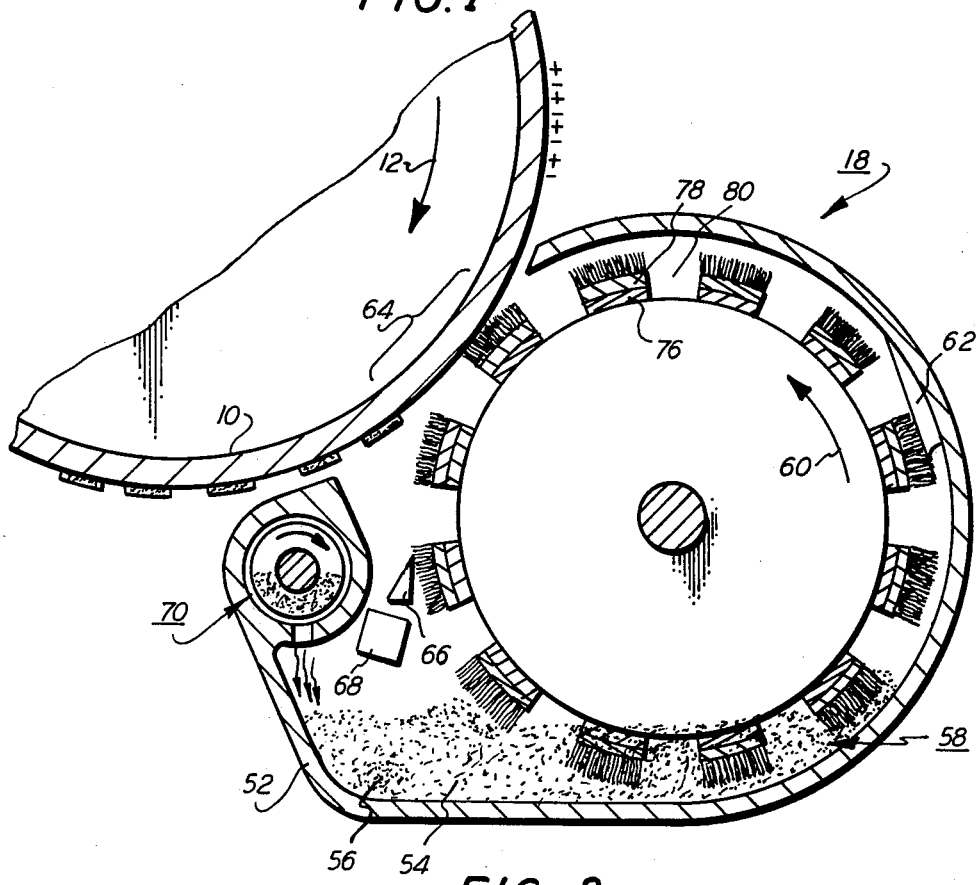
FIG. 2 is a schematic elevational view illustrating the development system used in the FIG. 1 printing machine.

Referring now to the specific subject matter of the present invention, FIG. 2 depicts development apparatus 18 in greater detail. Development apparatus 18 includes a housing 52 defining a chamber 54 for storing a supply of developer material 56 therein. A developer roller, indicated generally by the reference numeral 58, is mounted rotatably within housing 52. As developer roller 58 rotates, in the direction of arrow 60, it transports developer material 56 into contact with the photoconductive surface of drum 10. The developer material is magnetically attracted to the developer roller. The electrostatic latent image recorded on the photoconductive surface of drum 10 attracts the toner particles from the carrier granules to form a toner powder image thereon. A metering blade 62 secured to housing 52 has one edge thereof positioned closely adjacent to developer roller 58 defining a space therebetween through which developer material passes. Metering blade 62 shears the excessive developer material from developer roller 58. The extraneous developer material is separated from developer roller 58 and returns to the lowermost portions of housing 52. Developer roller 58 transports the remaining developer material into contact with the latent image forming a powder image on the photoconductive surface. One of the characteristics of developer roller 58 is self-leveling. As developer material 56 contacts the photoconductive surface, extraneous developer material passes through the spaces in developer roller 58 and returns to chamber 56 for subsequent reuse. The detailed structure of a development system of this type is disclosed in co-pending U.S. Patent application Ser. No. 80,650 filed in 1979, the relevant portions thereof being hereby incorporated into the present application.

With continued reference to FIG. 2, as developer roller 58 continues to rotate in the direction of arrow 60, the developer material remaining adherring thereto, after passing through development zone 64, has a portion thereof separated from roller 58 by blade 66. Blade 66 splits the flow of developer material so that a portion of the developer material passes through a detector 68. Detector 68 measures the concentration of toner particles within the developer material. It is clear that as toner particles are deposited on the electrostatic latent image, the concentration thereof within the developer material is reduced. In order to maintain optimum copy quality, the concentration of toner particles within the developer mixture must be maintained within defined limits. When the concentration is beneath these limits, copy quality deteriorates. Hence, detector 68 determines the concentration of toner particles within the developer mixture. A suitable detector is disclosed in U.S. Pat. No. Re 27,480 issued to Kamola in 1972, the relevant portions thereof being hereby incorporated into the present application. In a detector of this type, a light source transmits light rays through a pair of parallel electrically conductive plates. One of the plates is electrically biased to a suitable voltage to attract toner particles thereto. The intensity of the light rays transmitted through the plate is detected by a photosensor. The photosensor develops an electrical output signal which is compared by suitable logic to a reference signal. The resultant error signal is employed to energize a toner dispenser, indicated generally by the reference numeral 70. Preferably, toner dispenser 70, includes an auger for advancing toner particles from a supply source through a tube having suitable apertures therein for discharging of the toner particles into the lower portion of housing 52. These newly discharged toner particles are then mixed with the developer material so as to form a substantially uniform developer material having the desired triboelectric characteristics. The device for mixing the developer material is mounted interiorly of developer roller 58 and rotates therewith. The detailed structure of the mixing device will be shown hereinafter with reference to FIG. 3.

Figure 3:
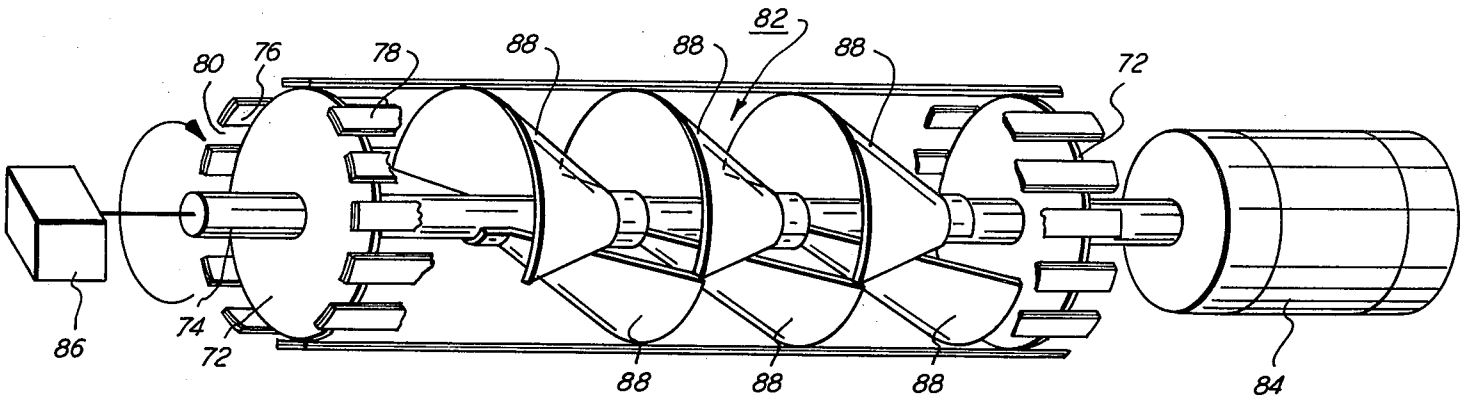
FIG. 3 is a schematic perspective view showing, in fragmentary, the cross-mixing system used in the FIG. 2 development system.

Turning now to FIG. 3, there is shown the detailed structure of developer roller 58 with the mixing device mounted interiorly thereof. As shown thereat, a plurality of discs 72 are fastened to shaft 74. Alternatively, wheels or apertured discs may be utilized in lieu of solid discs to further facilitate mixing. Bars 76 are supported by discs 72. Permanent magnetic strips 78 are secured to bars 76. Bars 76 are substantially equally spaced from one another defining spaces 80 therebetween. In addition, bars 76 extend in a direction substantially parallel to the longitudinal axis of shaft 74. Preferably, bars 76 are made from a soft magnetic iron which provides sufficient stiffness and support to hold the permanent magnetic strips 78 secured thereto. Magnetic strips 78 may be secured adhesively to bars 76. Spaces 80 permit the developer material to pass into the interior of developer roller 58. In the interior of developer roller 58, a mixing device, indicated generally by the reference numeral 82, thoroughly mixes the toner particles with the carrier granules. Mixing device 82 is mounted on shaft 74 so as to rotate with developer roller 58.

Motor 84 is coupled to shaft 74 to rotate both mixing device 82 and developer roller 58 in unison with one another in the direction of arrow 60. Preferably, motor 84 maintains developer roller 58 and mixing device 82 rotating at a substantially constant angular velocity. Voltage source 86 is coupled via a suitable means such as a slip ring to shaft 74. Inasmuch as discs 72 and bars 76 are electrically conductive, voltage source 86 electrically biases developer roller 58 to a suitable potential and magnitude. Preferably, voltage source 86 electrically biases developer roller 58 to a voltage level intermediate that of the background and image areas recorded on the photoconductive surface of drum 10, e.g. between 50 and 350 volts. Each magnetic strip 78 has a series of magnetic poles of alternating polarity impressed along the longitudinal axis thereof. Adjacent magnetic strips have magnetic poles of the same polarity opposed from one another. In addition, each magnetic strip is preferably electrically conductive. The electrical conductivity of the magnetic strips may be achieved by various techniques. For example, the magnetic material may be made conductive by adding carbon thereto or ceramic magnets may be employed. Alternatively, the magnetic strips may be made from rubber magnets overcoated with stainless steel foil or a carbon paint to provide the requisite conductivity.

Mixing device 82 includes a plurality of spaced apart conically shaped members 88. Conically shaped members 88 are half right circular cones, preferably being funnels. One set of funnel-shaped members has the apex of the cone pointing in one direction while the other set of funnel-shaped members has the apex of the cone pointing in the opposite direction along shaft 74. Thus, there are two rows of half cones or funnel-shaped members with all of the half cones in the same row or set pointing in the same direction and with the half cones in the other row or set pointing in the opposite direction. This arrangement is particularly effective inasmuch as it enables the conical members to be closely spaced by achieving full coverage of the interior of developer roller 58. In addition, this permits the use of the inside of the funnel-shaped members in the bottom row so as to extend the inclined surface, thereby promoting more rapid cross-mixing. As the mixing device rotates, the conical members switch in direction of deflection from right to left to produce substantially equal divisions of developer material flow. This overcomes the problem often experienced in other cross-mixing devices wherein the flow does not divide equally. If full cones having their apexes pointing in the same direction were to be used inside of developer roller 58, the developer material would be deflected in only one direction. To achieve full cross-mixing, the developer materials should be divided equally in opposite directions. This may be achieved by alternating the direction of full conical members along the length of shaft 74. However, it is more efficient to provide two rows of half cones with all of the half cones in the same row pointing in the same direction and with the half cones in the other row pointing in the opposite direction.

One skilled in the art will appreciate that at the cost of additional complexity, one could achieve a function similar to that of two rows of 180° cones with four rows of 90° cones which alternate in their direction or six rows of 60° cones. Surfaces of revolution other than those of right circular cones may also be employed to produce efficient cross-mixing. For example, a surface generated by revolving a parabola may also be employed.

In operation, as each magnetic strip 78 moves out of the developer material disposed in the sump of housing 52, the outer surface will be covered with a fairly uniform layer of developer material 56. As the magnetic strip moves into development zone 64, the developer material will be pulled through the development zone. Developer material which has difficulty in passing through the development zone, is merely pushed into the spaces 80 between adjacent magnetic strips 78. This produces a self-leveling effect to provide gentle toning of the latent image. This self-leveling feature permits large amounts of developer material to be transported into the development zone without creating unmanagable build-ups thereof. The unused developer material is forced through spaces 80 onto mixing device 82. Mixing device 82 rotates with developer roller 58 to intermingle the toner particles, and carrier granules with one another to produce a substantially uniform developer material having the desired triboelectric characteristics. After the magnetic strip has passed the development zone, the remaining developer material will be partially exchanged for new developer material. Preferably, the magnetic strips have a tangential velocity which is greater than the tangential velocity of drum 10. This minimizes the effects of strobing. Spaces 80 between adjacent magnetic strips 78 are of a sufficient size to permit the developer material to pass therethrough and away from the developing zone. Any developer material which does not pass through the development zone simply gets pushed inside developer roller 58 onto mixing device 82.

In recapitulation, it is clear that the improved development system of the present invention provides a relatively wide development zone while handling the developer material in a substantially gentle manner to optimize development of the electrostatic latent image on the photoconductive member. The developer roller includes an array of strip magnets arranged in a cylindrical envelope with spaces between adjacent magnets. A mixing device is disposed interiorly of the developer roller and rotates in unison therewith. With a developer roller of this type, a large excessive developer material can be transported to the development zone. The excessive developer material passes into the interior of developer roller where the mixing device rotating in conjunction therewith, provides intermingling of toner particles and carrier granules to produce a uniform developer material. Mixing of the developer material is achieved by causing the developer material to flow down the inclined surfaces of the mixing device. Rotation of the mixing device presents surfaces inclined in different directions. The flow of the developer material along these inclined surfaces promotes mixing of the toner particles and carrier granules.

It is, therefore, evident that there has been provided, in accordance with the present invention, an apparatus for developing an electrostatic latent image recorded on a photoconductive surface which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for developing a latent image with developer material, including:

a plurality of elongated magnetic members for attracting developer material thereto;

means for movably supporting said magnetic members with adjacent magnetic members being spaced from one another and the longitudinal axes thereof substantially parallel to one another so that said magnetic members form the exterior circumferential surface of a cylindrical configuration defining an interior chamber with developer material passing between adjacent magnetic members to the interior chamber, said supporting means moving said magnetic members to transport developer material to the latent image so as to deposit developer material thereon; and means, mounted on said support means in the interior chamber of the cylindrical configuration defined by said magnetic members to move in unison therewith, for mixing the developer material passing between adjacent magnetic members.

2. An apparatus according to claim 1, wherein said mixing means includes a plurality of conically shaped members extending in a longitudinal direction.

3. An apparatus according to claim 2, wherein said plurality of conically shaped members includes one set of spaced apart conically shaped members having the apex of the cone pointing in one direction and another set of spaced apart conically shaped members having the apex of the cone pointing in the other direction opposed from the direction of said one set of spaced apart conically shaped members.

4. An apparatus according to claim 3, wherein said one set of conically shaped members overlaps said other set of conically shaped members.

5. An apparatus according to claims 2, 3 or 4, wherein each of said conically shaped members is a semi-conically shaped member.

6. An apparatus according to claim 5, wherein each of said semi-conically shaped members is a partial funnel-shaped member.

7. An apparatus according to claim 6, wherein each of said plurality of magnetic members includes a magnetic strip with each of said magnetic strips being substantially parallel to one another.

8. An apparatus according to claim 7, wherein said supporting means includes:

a shaft having said funnel-shaped members mounted thereon;

at least a pair of spaced apart discs mounted on said shaft with said funnel-shaped members being positioned therebetween; and a plurality of spaced apart bars connecting said pair of discs to one another with each of said plurality of bars arranged to support one of said magnetic strips.

9. An apparatus according to claim 8, wherein said plurality of bars are substantially equally spaced from one another.

10. An apparatus according to claim 9, wherein each of said plurality of bars are connected to the outer periphery of said discs to define a cylindrical configuration with said funnel-shaped members being disposed interiorly thereof.

11. An apparatus according to claim 10, further including means, coupled to said shaft, for rotating said magnetic strips and said funnel-shaped members in unison with one another.

12. An electrophotographic printing machine of the type in which an electrostatic latent image recorded on a photoconductive member is developed with a developer material, wherein the improvement includes:

a plurality of elongated magnetic members for attracting developer material thereto;

means for movably supporting said magnetic members with adjacent magnetic members being spaced from one another and the longitudinal axes thereof substantially parallel to one another so that said magnetic members form the exterior circumferential surface of a cylindrical configuration defining an interior chamber with developer material passing between adjacent magnetic members to the interior chamber, said supporting means moving said magnetic members to transport developer material to the latent image so as to deposit developer material thereon; and means, mounted on said supporting means in the interior chamber of the cylindrical configuration defined by said magnetic members to move in unison therewith, for mixing the developer material passing between adjacent magnetic members.

13. A printing machine according to claim 12, wherein said mixing means includes a plurality of conically shaped members extending in a longitudinal direction.

14. A printing machine according to claim 13, wherein said plurality of conically shaped members includes one set of spaced apart conically shaped members having the apex of the cone pointing in one direction and another set of spaced apart conically shaped members having the apex of the cone pointing in the other direction opposed from the direction of said one set of spaced apart conically shaped members.

15. A printing machine according to claim 14, wherein said one set of conically shaped members overlaps said other set of conically shaped members.

16. A printing machine according to claims 13, 14 or 15, wherein each of said conically shaped members is a semi-conically shaped member.

17. A printing machine according to claim 16, wherein each of said semi-conically shaped members is a partial funnel shaped member.

18. A printing machine according to claim 17, wherein each of said plurality of magnetic members includes a magnetic strip with each of said magnetic strips being substantially parallel to one another.

19. A printing machine according to claim 18, wherein said supporting means includes:

a shaft having said funnel-shaped members mounted thereon;

at least a pair of spaced apart discs mounted on said shaft with said funnel-shaped members being positioned therebetween; and a plurality of spaced apart bars connecting said pair of discs to one another with each of said plurality of bars being arranged to support one of said magnetic strips.

20. A printing machine according to claim 19, wherein said plurality of bars are substantially equally spaced from one another.

21. A printing machine according to claim 20, wherein each of said plurality of bars are connected to the outer periphery of said pair of discs to define a cylindrical configuration with said funnel-shaped members being disposed interiorly thereof.

22. A printing machine according to claim 21, further including means, coupled to said shaft, for rotating said magnetic strips and said funnel-shaped members in unison with one another.

* * * * *